US011794987B2

(12) United States Patent
Wagenhofer et al.

(10) Patent No.: US 11,794,987 B2
(45) Date of Patent: Oct. 24, 2023

(54) CONTAINER AND CONNECTOR ASSEMBLY FOR A CONTAINER

(71) Applicant: Mubea Carbo Tech GmbH, Salzburg (AT)

(72) Inventors: Daniel Wagenhofer, Abtenau (AT); Christian Heigl, Landau an der Isar (DE)

(73) Assignee: MUBEA CARBO TECH GMBH, Salzburg (AT)

( * ) Notice: Subject to any disclaimer, the term of this patent is extended or adjusted under 35 U.S.C. 154(b) by 41 days.

(21) Appl. No.: 17/281,499

(22) PCT Filed: Oct. 2, 2019

(86) PCT No.: PCT/EP2019/076693
§ 371 (c)(1),
(2) Date: Mar. 30, 2021

(87) PCT Pub. No.: WO2020/070185
PCT Pub. Date: Apr. 9, 2020

(65) Prior Publication Data

US 2021/0395005 A1 Dec. 23, 2021

(30) Foreign Application Priority Data

Oct. 2, 2018 (CH) ..... 01200/18
Apr. 18, 2019 (CH) ..... 00538/19

(51) Int. Cl.
*B65D 90/08* (2006.01)
*B65D 88/14* (2006.01)
*B65D 90/02* (2019.01)

(52) U.S. Cl.
CPC ..... *B65D 90/08* (2013.01); *B65D 88/14* (2013.01); *B65D 90/021* (2013.01); *B65D 90/022* (2013.01)

(58) Field of Classification Search
CPC ..... B65D 90/08; B65D 88/14; B65D 90/021; B65D 90/022; B65D 90/00; B65D 90/02;
(Continued)

(56) References Cited

U.S. PATENT DOCUMENTS 8,596,013 B2 * 12/2013 Boo ..... E04C 2/38 52/588.1
9,174,796 B2 * 11/2015 Holland ..... B65D 88/14
(Continued)

FOREIGN PATENT DOCUMENTS

DE 4331835 A1 3/1995
WO 2010097378 A1 9/2010
(Continued)

OTHER PUBLICATIONS

PCT/EP2019/076693, International Search Report dated Dec. 12, 2019.

*Primary Examiner* — John K Fristoe, Jr.
*Assistant Examiner* — Laura E. Parker
(74) *Attorney, Agent, or Firm* — GrowIP Law Group LLC

(57) ABSTRACT

The disclosure is directed to a connector assembly mechanically interconnecting first and second structural entities of an aircraft container. The connector assembly has first and second connector parts fastened to the first and second structural entities, respectively. In a connected state, relative movement of the second connector part is restricted with respect to the first connector part in a first direction along a first axis of action. The connector assembly has a force-limiting arrangement in a connected state that limits relative movement of the second connector part with respect to the first connector part in a second direction opposite to the first direction. When an external force is applied to the second connector part and the external force has a first force component acting in the second direction and exceeding a threshold force the force-limiting arrangement allows the
(Continued)

second connector part to move relative to the first connector part.

23 Claims, 5 Drawing Sheets

(58) Field of Classification Search
CPC ... B65D 19/385; Y10T 403/00; Y10T 403/11; Y10T 403/42; Y10T 403/7096; Y10T 403/73; F16B 31/021
USPC ..... 220/1.5; 52/98; 403/2, 205, 382, 403; 411/3, 5, 390
See application file for complete search history.

(56) References Cited

U.S. PATENT DOCUMENTS

2005/0011890 A1* 1/2005 Adler ..... B65D 88/14 220/1.5
2008/0226386 A1* 9/2008 Yoshino ..... B60R 16/0215 403/2
2010/0021096 A1* 1/2010 Winkler ..... B64D 11/003 29/898.07
2011/0248143 A1* 10/2011 Pierson ..... E01F 9/635 248/548
2014/0131371 A1* 5/2014 Huber ..... B65D 88/14 220/691
2015/0041461 A1* 2/2015 Daoud ..... B65D 90/08 220/1.5
2015/0059259 A1* 3/2015 Hatzinikolas ..... E04B 1/941 52/98
2015/0159362 A1* 6/2015 Pryor ..... E04B 1/1903 52/655.1

FOREIGN PATENT DOCUMENTS

WO 2012168305 A1 12/2012
WO 2013142096 A1 9/2013

* cited by examiner

CONTAINER AND CONNECTOR ASSEMBLY FOR A CONTAINER

CROSS-REFERENCE TO RELATED APPLICATIONS

This application claims the benefit of the filing date of international PCT Application No. PCT/EP2019/076693, filed on Oct. 2, 2019, that in turn claims priority to Swiss Patent Application No. CH00538/19, filed on Apr. 18, 2019, and to Swiss Patent Application No. CH01200/18, filed on Oct. 2, 2018, the contents of which are hereby incorporated by reference in their entirety.

TECHNICAL FIELD

The present disclosure relates to a connector assembly for a container, preferably for an aircraft container. The present disclosure further relates to a container comprising such a connector assembly and to a structural module for such a container.

BACKGROUND

WO2013/142096 A1 was published on 26 Sep. 2013 on behalf of Leading Lite Composites LLC and discloses a lightweight composite cargo container, in particular also a Unit Load Device, which includes a base panel composed of one or more composite laminate materials. It also discloses a frame including a frame first portion that extends from the base panel along a first direction and a frame second portion that extends from the frame first portion along a second direction that is perpendicular to the first direction. A frame third portion extends from the frame first and second portions along a third direction that is perpendicular to the first and second directions. According to WO2013/142096 A1, the frame comprises composite laminate, and the frame comprises the primary structure of the unit load device. According to WO2013/142096 A1, one or more side panels are attached to the frame and the one or more side panels comprise composite laminate. A top panel is attached to an opposite end of the frame as the base panel and the top panel comprises composite laminate. Such types of unit load devices comprise typically high numbers of connectors that interconnect the frame portions using a plurality of mechanical fasteners. If a frame portion fails, e.g. due to overloading, replacement of a defective portion often turns out to be laborious and time-consuming.

SUMMARY

In order to provide a concise description of the invention, it will be described mainly for use for aircraft containers, although not limited to such types of containers.

Containers that can be used as cargo containers for aircraft have to meet a variety of requirements. One of the most prominent requirements is that they must be lightweight in order to be used in aircraft. Another requirement is that they must have a specified and standardized shape. So-called Unit Load Device (ULD) containers are a special type of container that meets special regulations published by the International Air Transport Association (IATA). ULD containers typically are made from lightweight metals (most commonly aluminum) or are hybrid structures comprising a framework made from a lightweight metal and walls made from a plastic material which is arranged at the framework's panels. However, in recent years cargo containers at least partially made from composite materials, such as fiber-reinforced plastics, have also emerged. These containers typically offer high strength and stiffness while having a significantly lower weight if compared to cargo containers made from aluminum. As well, these types of containers have other advantages, such as that they can be scanned with low-energy x-ray systems.

During fast-paced daily operations at airports, containers may be physically damaged when being loaded or unloaded, during transport on the apron or even when being loaded to or unloaded from an aircraft. In general, an aircraft container on the ground is always at risk of damage, either by being hit by ground support equipment (GSE) or when loading or unloading a dolly. Due to their lightweight design aircraft containers are relatively susceptible to mechanical damage if compared e.g. to containers made from steel. While certain types of mechanical damage (e.g. minor local deformations, like dents) may be uncritical, as they do not affect neither the structural competence of the container nor the maximum outer contour of the container (as defined by official regulations), other types of mechanical damage make a container unfit for flight. There is a general need for fast and easy repair of defective containers. One reason for this is that most airport cargo facilities have limited storage capacity and hence only limited space for storing spare containers or defective containers. However, it has been found that in some cases repair of containers turns out to be complicated and time-consuming. A reason for this is that even relatively minor mechanical impacts on a container may result in substantial deformation or other type of damage to a large portion of its structure (e.g. framework). This holds true for many types of conventional ULD containers and in particular for containers comprising composite materials. Such composite types of ULD containers in many cases cannot readily be repaired on site and hence need to be sent to special repair facilities. The present disclosure makes it possible to obtain containers that are significantly less susceptible to major mechanical damage but still have a high mechanical competence, hence fulfill the requirements given in the official regulations. In particular, containers based on the present disclosure typically stay within a maximum outer contour as defined in official regulations, which is important in order not to cause damage to the fuselage of an aircraft. At the same time, the disclosure allows containers that can be repaired fast and easily—even if composite structures, such as structures made from fiber-reinforced plastics. Connector assembly according to the present disclosure is highly advantageous when being used for interconnecting structural entities (e.g. beams or plates) that are at least partially made from composite materials, such as fiber-reinforced plastics. A reason for this being that components made from such materials in many cases cannot be repaired on-site and hence have to be replaced by a spare part. As well, force introduction in structures made from fiber-reinforced plastics often turns out to be complicated if compared to e.g. aluminum. For example, the creation of tapped holes directly in these materials is typically not possible and therefore usually a kind of adapter (such as an insert or onsert made from a metal) has to be used for force introduction. However, most types of adapters either have to be applied already during production of a composite structure (such as inserts) or are fastened to the composite structure using an adhesive, hence needs some time for curing. As well, in the systems known from the prior art, overloading of a frame-work comprising multiple structural entities (e.g. beams) made from composite materials typically also leads to damage of the connectors that interconnect the structural entities. It is therefore often necessary to replace parts that actually are not critically damaged from a purely structural point of view.

In order to solve at least one of the aforementioned problems, a connector assembly for use in mechanically interconnecting a first and a second structural entity of an aircraft container typically comprises a first connector, which is configured to be fastened to a first structural entity of an aircraft container. A structural entity may e.g. be a base structure, like a base plate, or a shell structure or a beam structure, as will be shown in more detail below. Good results may be obtained if the structural entity is at least partially made from a composite material, such as a fiber-reinforced plastic, in particular a fiber-reinforced plastic with reinforcing fibers arranged in layers. Reinforcing fibers may be e.g. fibers made from carbon, polymer (e.g. aramide), glass, stone (e.g. basalt) or metal (e.g. steel) or combinations thereof. However, for other applications, a structural entity may also at least partially be made from a metal, preferably a lightweight metal, such as an aluminum, magnesium or titanium. Within the context of the present disclosure, "aluminum", "magnesium" and "titanium" should be understood as meaning also their alloys. Different structural entities of one aircraft container may be made from different materials, in particular hybrid designs comprising metal and non-metal materials, such as composites as described herein, may be used. A connector assembly according to the invention further comprises a second connector part, which is configured to be fastened to a second structural entity of the aircraft container. For fastening, the first and the second connector part may comprise fastening means such as e.g. a flange and/or a sleeve that can be at least partially inserted in an inner channel of a beam and/or in which sleeve at least part of a beam can be inserted. A fastening means may also comprise an opening to receive e.g. a bolt and/or a screw. Alternatively or in addition, a fastening means may also comprise a surface to establish an adhesive connection or a welding connection. According to the disclosure, when the connector assembly is in a connected state, the first and the second connector part are configured to restrict relative movement of the second connector part with respect to the first connector part in a first direction along a first axis of action. According to the disclosure, the connector assembly comprises a force-limiting arrangement that, when the connector assembly is in a connected state, limits relative movement of the second connector part with respect to the first connector part in a second direction along the first axis of action, the second direction opposite to the first direction. The force-limiting arrangement is configured such that when an external force is applied to the second connector part (respectively to a second structural entity fastened to the second connector part) and if the external force has a first force component that acts in the second direction and exceeds a specified first threshold force, the force-limiting arrangement allows the second connector part to move relatively to the first connector part. Thereby, the total force acting on a containers structure can be limited and hence damage be limited to only certain members of the containers structure. Due to the restriction in the first direction, for many load cases deformation of a container comprising such connector assemblies can be restricted to the inner volume of a given outer contour. Good results may be obtained if the relative movement in the first direction is restricted by a form fit, such as e.g. effected by a restraint. Therefore, a first stop means may be arranged at the first connector part and a corresponding second stop means may be arranged at the second connector part, the first and the second stop means preventing relative movements in the first direction when brought into contact. Particularly good results may be obtained if at least one of the first and the second stop means comprises a hook-shaped or clamp-shaped element as thus also relative movements in a third direction as well as rotational movements may be prevented as will be shown in more detail in the drawings.

For some applications, when in a connected state, the first and the second connector part may be configured to restrict relative movement of the second connector part with respect to the first connector part in a third direction along a second axis of action, which is essentially perpendicular (other alignments may be used for different types of applications) to the first axis of action. In such a variation of the disclosure, the force-limiting arrangement limits relative movement of the second connector part with respect to the first connector part in a fourth direction along the second axis of action, the fourth direction being opposite to the third direction. In such a variation of the disclosure, the force-limiting arrangement allows the second connector part to displace in the fourth direction with respect to the first connector part if a second force component of the applied external force acts in the fourth direction and exceeds a specified second threshold force. Using such a variation of a connector assembly according to the present disclosure may e.g. be used at corners of containers as will be shown in more detail below. The second threshold force may be different or equal to the first threshold force. According to a variation of the disclosure, the force-limiting arrangement may be configured such that when a first or a second threshold force is exceeded relative movement of the second connector part is only allowed in the associated direction while keeping restricted in the other direction. Alternatively, relative movement may be allowed in both directions.

According to a variation of the disclosure, the force-limiting arrangement is configured to allow relative movement of the second connector part with respect to the first connector part in a fourth direction as soon as the first force component exceeds the first threshold force. In such a case, the force-limiting arrangement allows relative movement of the second connector part with respect to the first connector part in a second direction as soon as the second force component exceeds the second threshold force.

According to a variation of the disclosure, when the connector assembly is in a connected state, the first and the second connector part are configured to restrict relative movement of the second connector part with respect to the first connector part along a third axis of action that is essentially perpendicular to the first axis of action and (if present) the second axis of action (if present). Such a third axis of action may be regarded as a main connector axis that is perpendicular to a separating/parting plane of the connector assembly, the first axis of action and (if present) the second axis of action being in parallel with the separating/parting plane.

Good results may be obtained if, when the connector assembly is in the connected state, a first rotation restriction means restricts rotations of the first and the second connector part relative to each other in at least one direction of rotation about a first axis of rotation. In such a variation of the disclosure, the first axis of rotation is typically essentially perpendicular to the first axis of action. Such a variation of a connector assembly may be advantageous particularly when being used for containers comprising frameworks in order to obtain a particularly rigid framework.

Alternatively, or in addition, at least one strut and/or at least one sheeting may be used, as will be explained in more detail below. Particularly good results may be obtained if a second rotation restriction means restricts rotations of the first and the second connector part relatively to each other in at least one direction of rotation about a second axis of rotation and wherein the second axis of rotation is essentially in parallel to the first axis of action.

According to a variation of the present disclosure, when the connector assembly is in a connected state, a third rotation restriction means may restrict relative rotations of the first and the second connector part relatively to each other in at least one direction of rotation about a third axis of rotation. In such a variation, the third axis of rotation is essentially perpendicular to the first axis and the second axis of action; this allows the connector assembly to transmit torque.

Good results may be obtained with a variation of the disclosure according to which the first rotation restriction means comprises at least one first rotation engagement surface arranged at the first connector part and at least one corresponding second rotation engagement surface arranged at the second connector part. According to such a variation, at least one first and one second engagement surfaces are arranged such that in the connected state they are in physical contact and thereby restrict rotations about the first axis of rotation in a first direction of rotation. For some applications, the first rotation restriction means may comprise at least one third rotation engagement surface arranged at the first connector part and at least one corresponding fourth rotation engagement surface arranged at the second connector part. According to such a variation, the at least one third and one fourth engagement surfaces are arranged such that in the connected state they are in physical contact and thereby restrict rotations about the first axis of rotation in a second direction of rotation that is opposite to the first direction of rotation. It is clear that according to the present disclosure, the same concept can also be applied for second and/or third rotation restriction means in an analogous manner. Particularly good results may be obtained if the first and/or the second and/or the third and/or the fourth engagement surface are arranged at a clamp/hook-like structure, as will be shown in more detail below.

In a variation of the disclosure, the force-limiting arrangement comprises at least one sacrificial member that fails under a critical force and thereby enables a relative movement of the second connector part with respect to the first connector part. Thus, the sacrificial member can be used in order to obtain the force-limiting effect and a first and/or a second threshold force can be set using different types or different numbers of sacrificial members. Different types of sacrificial members may e.g. differ from each other in the type of material they are made from. In addition, a sacrificial member may be used to indicate that a supercritical loading to a container had occurred.

According to a variation of the present disclosure, the sacrificial member comprises a shear pin (or shear bolt) that fails under the critical force. In a variation of the disclosure, the shear pin extends from the first to the second connector part. Good results may be obtained if the longitudinal axis of such a shear pin is essentially perpendicular to a first and/or second axis of action as described herein. In a variation of the disclosure, the connector assembly comprises bores that extend from the first to the second connector part and which are configured to receive a shear pin.

According to a variation of the disclosure, at least one sacrificial member is at least partially made from a plastic. Thus, mechanical damage to the first and the second connector part can efficiently be prevented. Good results may be obtained if a polyamide, e.g. a polyamide-6, is used. For certain applications, at least part of the sacrificial member is made from a material that changes its visual appearance when damaged, such as e.g. a material changing its color, or a transparent plastic be-coming opaque when being mechanically loaded, e.g. as due to the development of crazes as known from poly(methyl methacrylate) (PMMA). Thus, supercritical load that has occurred can be reliably detected visually. For some applications, the force-limiting arrangement may be arranged to be equipped with multiple sacrificial members. This allows setting a certain threshold force easily, depending e.g. on application and/or type of container. For some applications, a sacrificial member may be interconnected to the first and/or the second connector part by a retention means. Thus, formation of loose parts can be prevented, which is important when being used for aircraft or on an apron.

According to a variation of the disclosure, the connector assembly is arranged such that the first and the second connector part completely disconnect as soon as the force-limiting arrangement allows movements. According to another variation of the disclosure the first and the second connector part may also be mechanically interconnected by a retention means (e.g. a wire) that maintains a mechanical connection between the first and the second connector part.

A highly user-friendly variation of a connector assembly can be obtained if it comprises a centering means that assists in positioning the first and the second connector part relatively to each other when the connector assembly is in the connected state. Thus inter alia assembly of a container as well as installation of a sacrificial member can be simplified. Good results may be obtained if the centering means comprises at least one spring-thrust piece arranged at the first or at the second connector part and which engages with a recess arranged in the other connector part. Particularly precise positioning may be obtained if the spring-thrust piece comprises a sphere that can engage with a conical recess, as will be shown in more detail below. In a variation of the disclosure, the centering means is at least part of the force-limiting arrangement. Alternatively, or in addition, the first and/or the second connector part comprises at least one alignment means (e.g. a chamfer, as depicted in the drawings), which helps to align and connect the first connector part with the second connector part, as will be explained in more detail below. Good results may be obtained if the first connector part comprises at least one first alignment means that interacts with at least one second alignment means arranged at the second connector part. The alignment means may act as sliding surfaces to allow easier movement of the first connector part relative to the second connector part.

A particularly lightweight connector assembly may be obtained if the first and/or the second connector part is at least partially made from a plastic, preferably from a fiber-reinforced plastic. According to one variation of the disclosure, the first and/or the second connector part is at least partially made from a metal. Good results may be obtained if a first and/or the second connector part is made from a lightweight metal and at least partially made by die-casting. Thus, high numbers of connecting assemblies can be provided at a reasonable price. Alternatively, or in addition, the first and/or the second connector part may at least partially be machined.

The disclosure is further directed to providing a container, preferably an aircraft cargo container. Such a container typically comprises a base structure, which has at least three perimeter edges, preferably four perimeter edges, constituting a base plane. A container according to the disclosure further comprises a superstructure that is mechanically interconnected with the base structure by at least one connector assembly as described herein. The first connector part of said at least one connector assembly arranged at a perimeter edge and fastened to the base structure, such that the first axis of action is essentially in parallel with the base plane and the first direction points away from the base structure. A container that has a particularly high mechanical competence can be obtained if at least one first connector part is arranged at a corner of the base structure. A highly versatile variation of a container according to the disclosure may be obtained if the container base structure comprises four edges and four corners, wherein at each corner a connector assembly as described herein is arranged and aligned with its first direction pointing away from the base structure. A particularly lightweight variation of a container may be obtained if the base structure and/or the superstructure is at least partially made from a composite material, such as a fiber-reinforced plastic as described herein. For some applications, at least part of the base structure and/or at least part of the superstructure may be made from wood or from a metal, such as a steel or a lightweight metal as described herein. Hence, the herein described disclosure may be used to obtain metal-types as well as composite-types and hybrid-types of containers.

A particularly lightweight and at the same time mechanically competent container can be obtained if the superstructure comprises multiple beams that constitute a framework. Good results may be obtained if at least some of the beams are at least partially made from a fiber reinforced plastic.

According to a variation of the disclosure, the framework comprises at least one vertical beam that is aligned essentially perpendicular to the base plane and comprises a first beam end that is fastened to the second connector part of the at least one connector assembly. A vertical beam typically extends in vertical direction from the base structure. It may be a straight beam, but may also have at least one bend, respectively be curved, as will be shown in more detail in the drawings.

According to a variation of the disclosure which allows particularly easy repair and at the same time provides good protection against major structural damage can be obtained if the at least one vertical beam has a second beam end that is fastened to the second connector part of a second connector assembly, the second connector assembly arranged such that the first axis of action of the second connector assembly is essentially in parallel with the base plane and the first direction of the second connector assembly points to the outside of the container and the first connector part of the second connector assembly is fastened to a top structure of the superstructure. The top structure may e.g. comprise a framework and/or a shell and/or a plate.

According to a variation of the disclosure, the superstructure comprises at least one horizontal beam that has a first beam end, which is fastened to the second connector part of a first connector assembly. As well, the at least one horizontal beam comprises a second beam end that is fastened to the second connector part of a second connector assembly. According to such a variation, the first connector part of the first connector assembly is fastened to a first vertical beam and the first connector part of the second connector assembly is fastened to a second vertical beam. As well, according to such a variation the axes of action of the first and the second connector assembly are aligned such that first direction points to the outside of the container. According to a variation of the disclosure the first connector part of the first connector assembly is fastened to the first vertical beam in the region of a bend and the first connector part of the second connector assembly is fastened to the second vertical beam in the region of a bend. Such a variation of the disclosure may be advantageous in order to obtain containers that are contoured to the fuselage of an aircraft, such as e.g. a so-called contoured Unit Load Device (ULD).

In order to improve the mechanical competence of a superstructure comprising a framework that has at least one panel, at least one strut may be applied to inter-connect two diagonally opposite corners of the panel. The strut may e.g. comprise a rod-like structure that is able to be loaded under tension and compression or a wire or rope that can be loaded under tension only. Thus, the stiffness of the super-structure can be significantly increased, which makes it possible to comply with mandatory regulations concerning the stiffness of containers even if a particularly lightweight design is used.

Alternatively, or in addition, at least one panel of a framework may be at least partially covered by a sheeting. A sheeting may comprise e.g. a tarpaulin and/or a sheet metal and/or a plastic sheet and/or a fiber-reinforced plastic sheet. Good results may be obtained if the sheeting is fixedly interconnected with the beams (or other types of structural entities) delimiting the panel such that a shear panel is formed.

According to a variation of the disclosure, the container is an aircraft container, preferably a Unit Load Device type of container.

The present disclosure is also directed to providing a structural module to be used for a container. Such a structural module comprises at least one structural entity and at least one first or second connector part of a connector assembly as described herein. Thus, mechanically damaged structural entities of a container as described herein can be quickly and easily replaced, even if at least partially made from a fiber-reinforced plastic. A structural entity may e.g. be a base structure, like a base plate, or a shell structure or a beam structure, as will be shown in more detail below. The structural entity may be at least partially made from a composite material, such as a fiber-reinforced plastic, in particular a fiber-reinforced plastic with reinforcing fibers arranged in layers. However, for other applications, a structural entity may also at least partially be made from a metal, preferably a lightweight metal, such as an aluminum, magnesium or titanium.

According to a variation of the disclosure, the container may comprise various panels extending between the superstructure and/or the base structure to enclose a cargo space. If the superstructure and/or the base structure comprise beams, as explained above, the panels preferably extend (at least) between the beams of the superstructure and/or the base structure. Good results may be obtained if the panel is a sheer panel absorbing forces acting on the container, respectively the super-structure and/or the base structure. As described above, these panels may be made at least partially from materials such as lightweight metals (most commonly aluminum), plastic materials (e.g. plastic sheets or tarpaulin) or composite materials (e.g. fiber-reinforced plastics). The panels are preferably attached to the super-structure and/or the base structure via interconnection means, such as e.g. angled profiles. The angled profiles may be e.g. L- or U-shaped. If the superstructure and/or the base structure comprise beams, as explained above, the interconnection means advantageously attach the panels to the respective beams.

According to a variation of the disclosure, a rear side of the container may comprise at least one tapered surface. If two such containers are loaded into the hold of an airplane with the respective front sides (arranged opposite of the rear sides) abutting against each other, the container pair fits more neatly against the tubular cargo space walls of an aircraft, hence offering a beneficial space utilization of the hold. The rear side of the container may be covered by a single rear panel having a tapered surface or by multiple rear panels, wherein one panel covers the tapered surface. Due to structural reasons, the at least one rear panel is preferably made from sheet metal. For additional stiffness, the superstructure preferably may feature an additional beam in the area of the tapered surface and/or the at least one rear panel covering the tapered surface may feature a thicker sheet metal.

According to a variation of the disclosure, at least one removable panel may cover a cargo opening into a cargo space of the container, where the cargo is stored. The removable panel enables the cargo opening of the container to temporarily close and provides an easy access to the cargo space inside the container during loading and unloading. Preferably, the removable panel is made from plastic such as e.g. plastic tarpaulin, which is light and easy to remove and reattach. Furthermore, the cargo opening, respectively the removable panel, is preferably arranged on a side surface of the container (arranged between the front side and the rear side). The largest possible opening is achieved, if the removable panel extends over the entire side surface of the container. Preferably, the removable panel has the shape of the cross-section of the cargo space in direction parallel to the removable panel. Generally, the larger the cargo opening, the less stable and stiff is the overall structure of the container. Therefore, most cargo openings are designed smaller, such that they extend only partially over a side of the container. However, due to a combination of the connector assembly and the superstructure/base structure, a sufficiently stiff structure can be achieved, such that the cargo opening may be designed extending over the entire side surface and thereby providing a spacious cargo opening.

Depending on the design of the container, respectively the presence and the shape of the tapered surface, as explained above, the respective panels arranged on the side surfaces of the container may have five or six corners (or more). The top panel and/or the bottom panel and/or the front panel of the container can be rectangular. The panel arranged on the side surface of the container may however have the shape of an irregular hexagon or an irregular pentagon.

Alternatively, or in addition, the removable panel may further be designed as a roller blind with an open position where the cargo opening is open and a closed position where the cargo opening is closed and a roller sheet of the roller blind is extended. Preferably, the roller sheet is a plastic tarpaulin. The roller blind may further comprise a winding role, arranged at the superstructure or the base structure. Preferably, the winding role is arranged on an upper horizontal edge of the side surface (abutting against the top side). The extended roller sheet may be locked by a locking means at an opposite side of the cargo opening, e.g. on respective beams of the superstructure or the base structure. Furthermore, guiding means may be attached on the superstructure or the base structure guiding the roller sheet during opening and closing on the outer sides and further strengthening the roller blind in the closed position. The guiding means may further comprise clamping means to clamp the roller sheet on the outer sides such that the roller sheet is prevented from slipping out of the guiding means. The roller sheet may extend over an entire side surface of the container and may have a non-rectangular shape such as e.g. the shape of an irregular hexagon or an irregular pentagon.

The connector assembly as described above may comprise at least one panel made of composite material and/or metal and/or plastic. In a preferred variation of the disclosure, the at least one rear panel is made from metal meanwhile at least one removable panel is made from plastic or features a roller blind. The top side and/or the bottom side and/or the remaining side panel (opposite of the removable panel) may be made of composite material. However, other combinations of materials are also possible.

It is to be understood that both the foregoing general description and the following detailed description present embodiments, and are intended to provide an over-view or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF THE DRAWINGS

The herein described invention will be more fully understood from the detailed description given herein below and the accompanying drawings, which should not be considered limiting to the invention described in the appended claims.

DETAILED DESCRIPTION

Reference will now be made in detail to certain embodiments, examples of which are illustrated in the accompanying drawings, in which some, but not all features are shown. Indeed, embodiments disclosed herein may be embodied in many different forms and should not be construed as limited to the embodiments set forth herein; rather, these embodiments are provided so that this disclosure will satisfy applicable legal requirements. Whenever possible, like reference numbers will be used to refer to like components or parts.

Figure 1:
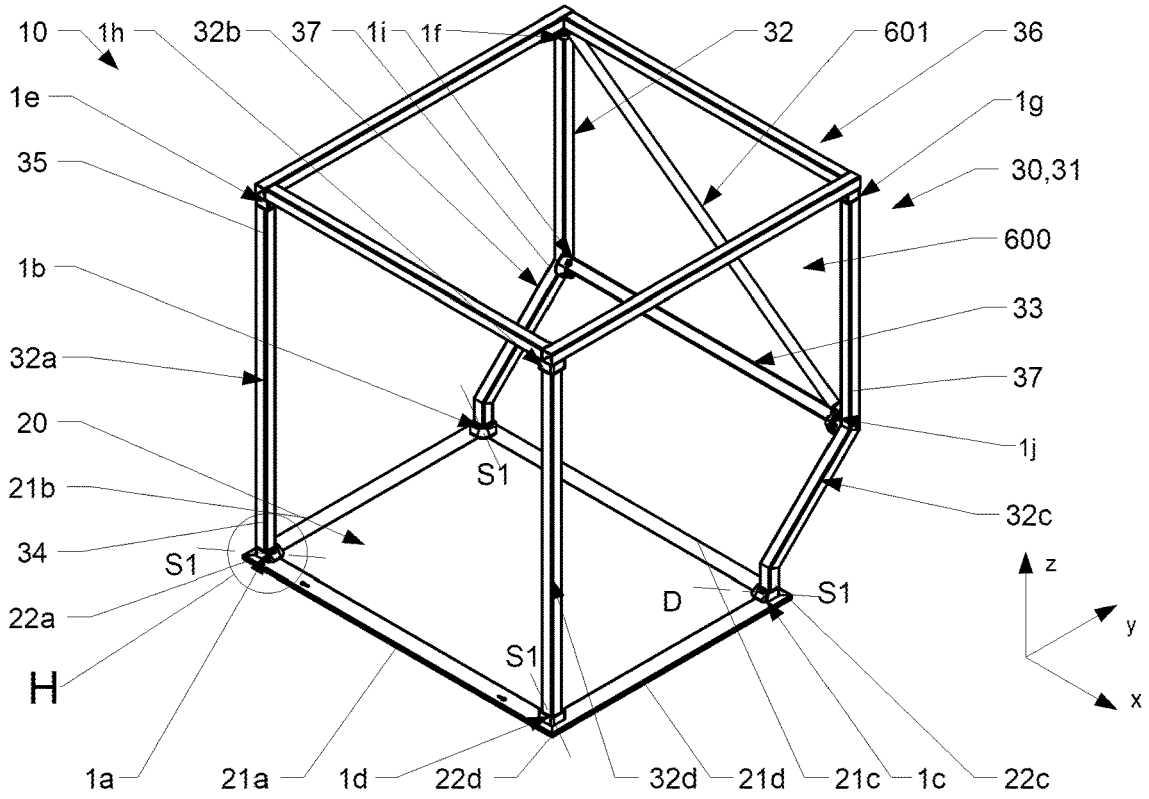
FIG. 1 schematically shows a variation of a container according to the present disclosure in a perspective view from above.
Figure 2:
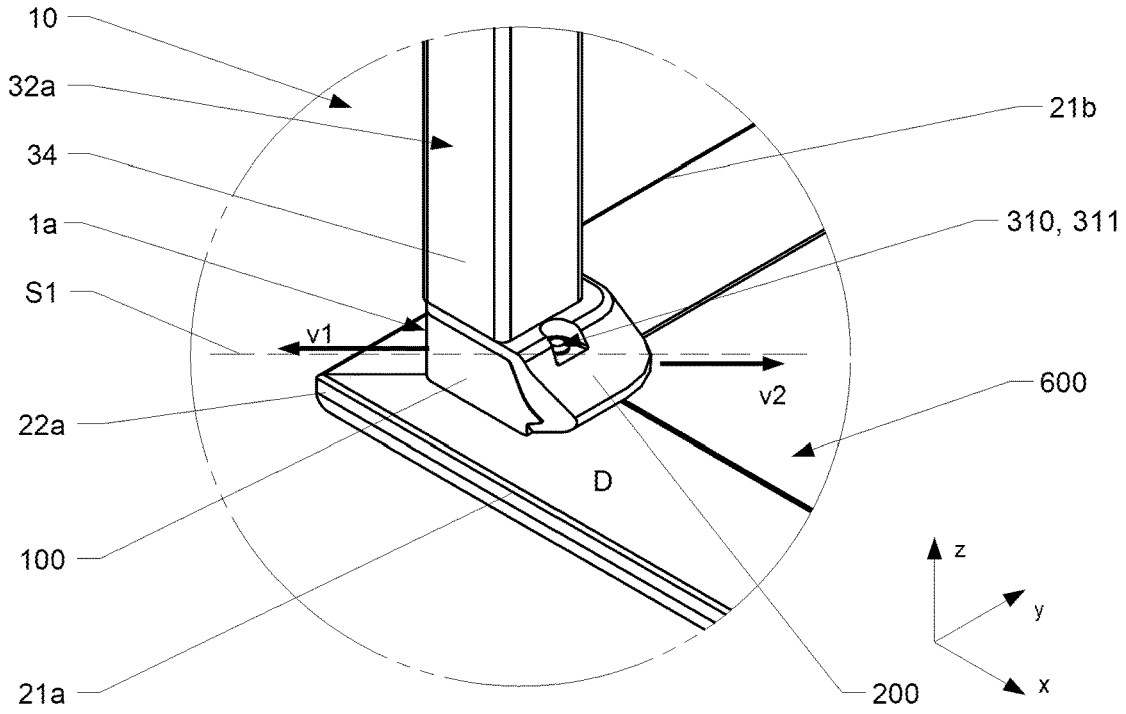
FIG. 2 shows detail H of FIG. 1.

FIGS. 1 and 2 depict a variation of a container 10 according to the present disclosure, which has a base structure 20 that comprises four perimeter edges 21*a-d* that constitute a base plane D. The container 10 further comprises a superstructure 30 that is mechanically interconnected with the base structure 20 by four connector assemblies 1*a-d* according to the present disclosure. These four connector assemblies 1*a-d* each comprise a first connector part 100 that is arranged at a perimeter edge 21*a-d* and fastened to the base structure 20. Each connector assembly 1*a-d* has a first axis of action S1 that is essentially in parallel with the base plane D and aligned such that first directions v1 of the connector assemblies 1*a-d* point away from the base structure 20, respectively point to the outside of the container 10. As can be seen, the superstructure 30 comprises multiple beams 32*a-d*, 33 that constitute a framework 30. All beams 32*a-d*, 33 of the embodiment of a framework 31 shown are essentially made from a carbon-reinforced plastic. However as described above, for other applications also at least some structural entities, respectively beams 32*a-d*, 33, may be at least partially made from a metal. The framework 31 comprises vertical beams 32*a-d*, which are aligned essentially perpendicular to the base plane D and positioned at the four corners 22*a-d* of the base structure 20. The lower beam ends 34 of the vertical beams 32*a-d* are fastened to second connector parts 200 of four connector assemblies 1*a-d*. As well, the vertical beams 32*a-d* have second beam ends 35 that are fastened to the second connector parts 200 of four connector assemblies 1*e-h* that are arranged close to the top of the container 10. These top connector assemblies 1*e-h* are arranged such that their first axes of action S1 (not shown in the Figures) are essentially also in parallel with the base plane D and their first directions v1 (not shown in the FIGS. point to the outside of the container 10. The first connector parts 100 of the second connector assemblies 1*e-h* are fastened to a frame-like top structure 36 of the superstructure 30. The two vertical beams 32*b*, 32*c* arranged at the rear side of the container 10 as shown in FIG. 1 are not straight but bent and interconnected with each other by a horizontal beam 33 that at its both ends is interconnected with the vertical beams 32*b*, 32*c* at the bends 37 by means of connector assemblies 1*i*, 1*j*. The connector assemblies 1*i*, 1*j* are aligned such that they comprise first directions v1 (not shown in detail) that point to the outside of the container 10.

Figure 3:
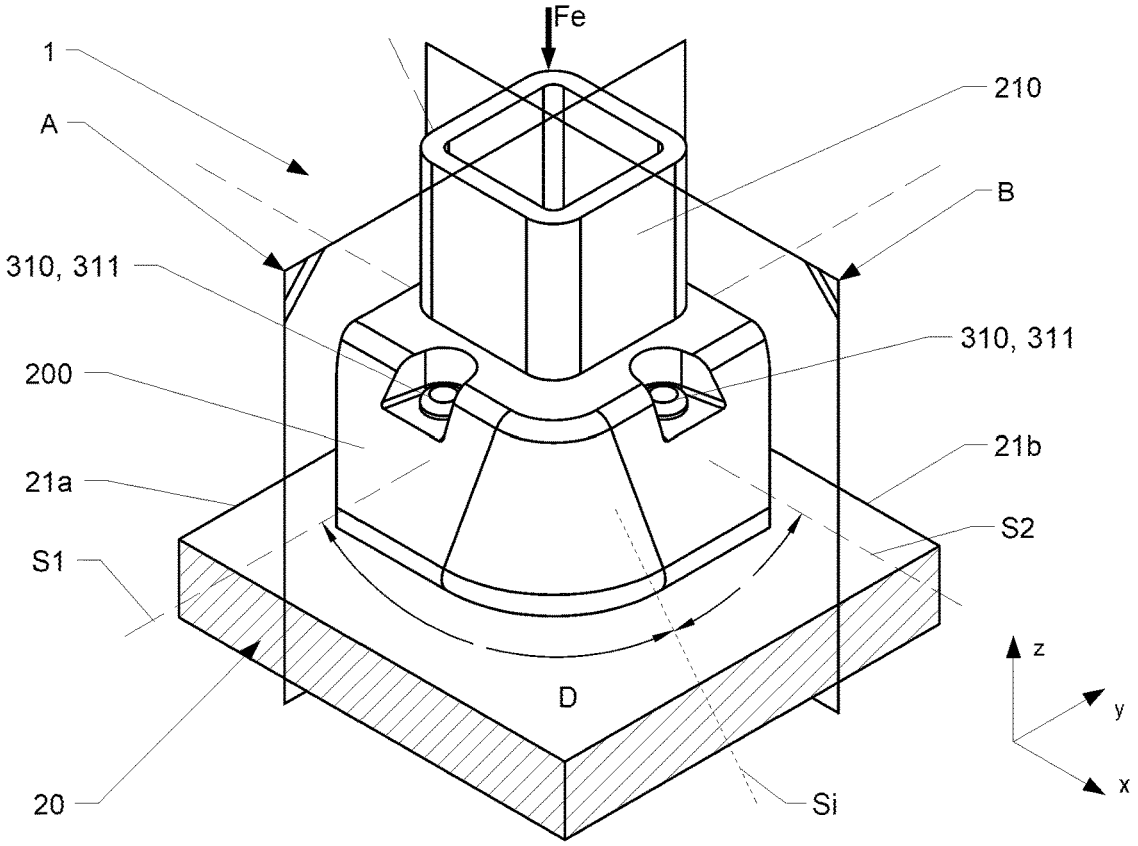
FIG. 3 schematically shows a variation of a connector assembly fastened to a base structure in a perspective view from above.
Figure 4:
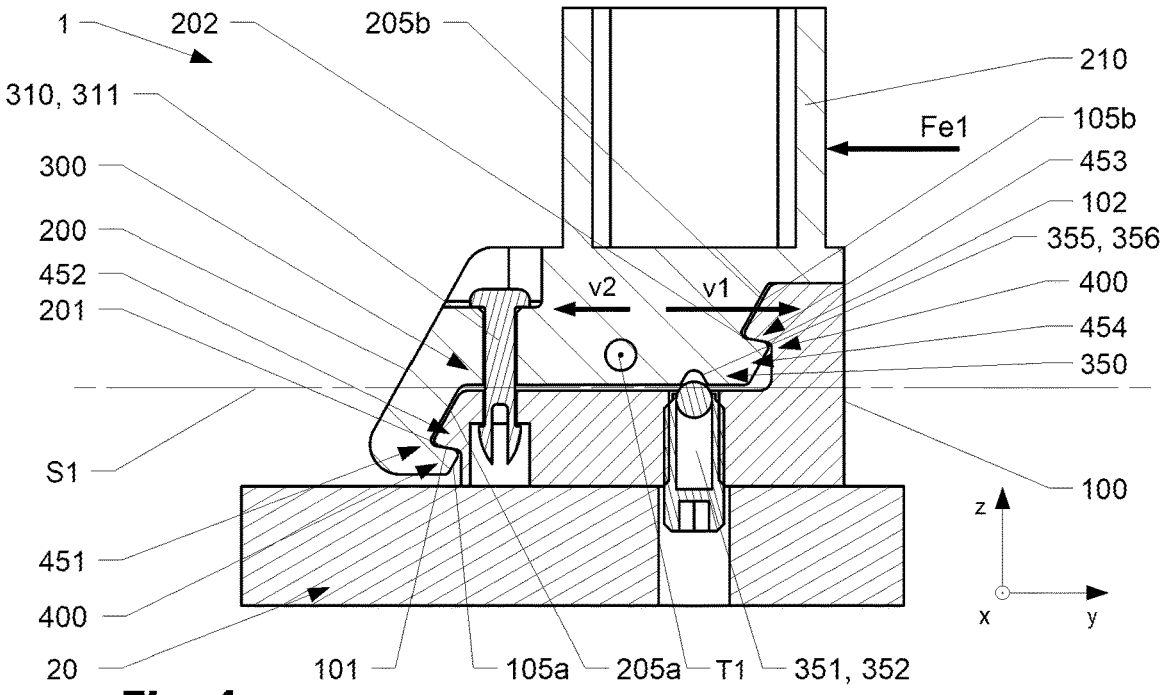
FIG. 4 shows cross-section A of FIG. 3
Figure 5:
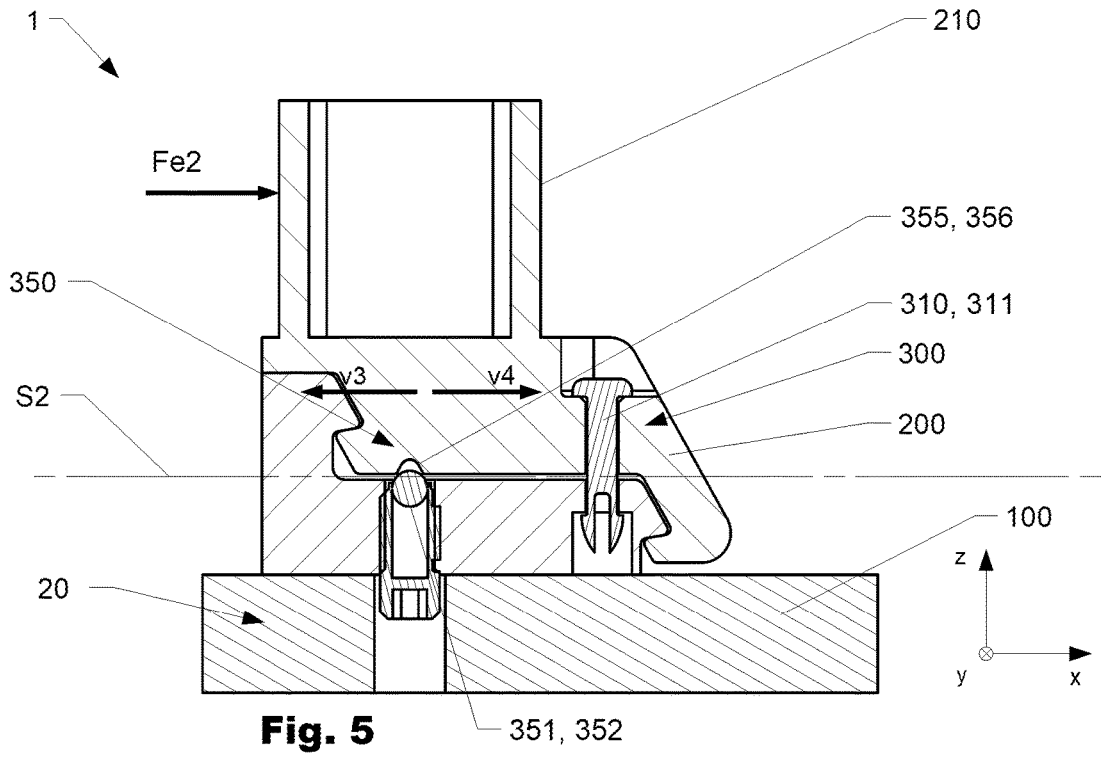
FIG. 5 shows cross-section B of FIG. 4.
Figure 6:
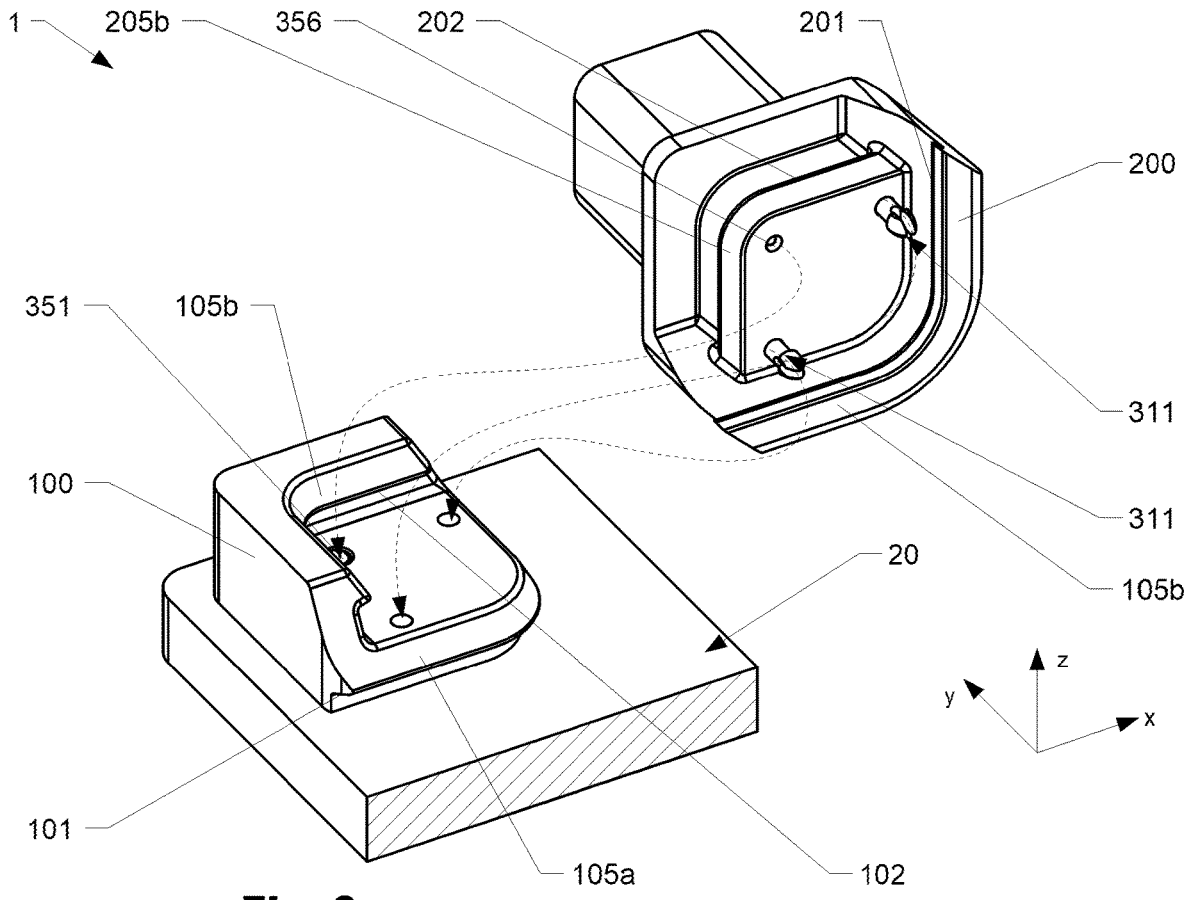
FIG. 6 schematically shows a first and a second connector part of a variation of a connector assembly according to the present disclosure in a perspective view from above.

FIGS. 3 to 6 depict a variation of a connector assembly 1 according to the present disclosure. As shown in FIG. 3, the connector assembly 1 has a second connector part 200 that comprises a sleeve which acts as a second fastening means 210 in order to establish a good mechanical interconnection with a beam (not shown). As shown in FIGS. 3 and 4, when the connector assembly 1 is in a connected state, the first connector part 100, comprising first stop means 451, 453, and the second connector part 200, comprising corresponding second stop means 452, 454, restrict relative movement of the second connector part 200 with respect to the first connector part 100 in a first direction v1 along a first axis of action S1. In this variation, the first axis of action S1 is essentially in parallel to the y-axis. As well, the connector assembly 1 comprises a force-limiting arrangement 300 that comprises two sacrificial members 310 embodied as shear pins 311. When the connector assembly 1 is in a connected state as shown in FIGS. 3 to 5, these shear pins 311 limit relative movement of the second connector part 200 with respect to the first connector part 100 in a second direction v2 opposite to the first direction v1 and along the first axis of action S1. The shear pins 311 of the variation shown are made from a plastic material and configured such that they fail under a certain loading which defines a first threshold force, such that when an external force Fe is applied to the second connector part 200 having a first force component Fe1 that acts in the second direction v2 and exceeds a first threshold force the shear pin 311 fails and consequently allows the second connector part 200 to move relative to the first connector part 100. In addition to the shear pins 311, the connector assembly also comprises a centering means 350 that assists in positioning of the first and the second connector part 100, 200 relative to each other when the connector assembly 1 is in the connected state. The centering means 350 comprises a spring-thrust piece 352 arranged at the first connector part 100 and which engages with a recess 356 arranged in the other connector part 200 and hence constitutes a second centering means part 355. Such a variation of a centering means 350 also allows the second connector part 200 to be retained in a connected position during assembly of a container (not shown) before the shear pins 311 are inserted and hence may serve as an assembly aid. In addition, when the connector assembly 1 is in a connected state, the first and the second connector part 100, 200 are configured to restrict relative movement of the second connector part 200 with respect to the first connector part 100 in a third direction v3 along a second axis of action S2. In the variation shown, the second axis of action S2 is essentially perpendicular to the first axis of action S1 (and in parallel to the x-axis). As well, the force-limiting arrangement 300 also limits relative movement of the second connector part 200 with respect to the first connector part 100 in a fourth direction v4 opposite to the third direction v3 and allows the second connector part 200 to displace in the fourth direction v4 with respect to the first connector part 100 if a second force component Fe2 of the applied external force Fe acts in the fourth direction v4 and exceeds a specified second threshold force. It is clear that the variation of a connector assembly 1 as shown in these Figures comprises multiple axes of action Si with a range of orientations (in FIG. 3 illustrated by the curved arrows), which all relate to directions in which relative movements of the second connector part 200 are restricted and opposite directions in which such movements are allowed. As also shown in FIGS. 4 and 5, in the variation of a connector assembly 1 shown the first connector part 100 comprises two first alignment means 105*a*,105*b* that interact with two second alignment means 205*a*,205*b* that are arranged at the second connector part 200. These alignment means 105*a*,105*b*, 205*a*,205*b* are essentially embodied as chamfers and help to align the first connector part 100 with the second connector part 200 in order to establish a proper connection between the two of them. Such a variation is e.g. particularly advantageous if a damaged structural module of a container has to be replaced and the residual structure is (non-critically) deformed.

As well, the connector assembly 1 shown in FIGS. 3 to 4 comprises a first rotation restriction means 400 that restricts rotations of the first and the second connector part 100, 200 relatively to each other in at least one direction of rotation about a first axis of rotation T1 that is perpendicular to the first axis of action S1. The first rotation restriction means 400 therefore comprises a first rotation engagement surface 101 that is arranged at the first connector part 100 and a corresponding second rotation engagement surface 201 arranged at the second connector part 200. The at least one first and second engagement surfaces 101, 201 are arranged such that in the connected state they are in physical contact and thereby restrict rotations about the first axis of rotation T1 in a first direction of rotation. In order to restrict rotations about the first axis of rotation T in the opposite direction of rotation, a third rotation engagement surface 102 is arranged at the first connector part 100 and a corresponding fourth rotation engagement surface 202 arranged at the second connector part 200 and act in an analogous manner like the first and the second rotation engagement surfaces 101, 201. These rotation engagement means 101, 102, 201, 202 are arranged at hook/clamp-like structures which at the same time allow relative movement of the second connector part 200 to restrict with respect to the first connector part 100 in the vertical direction (z-axis).

Figure 7:
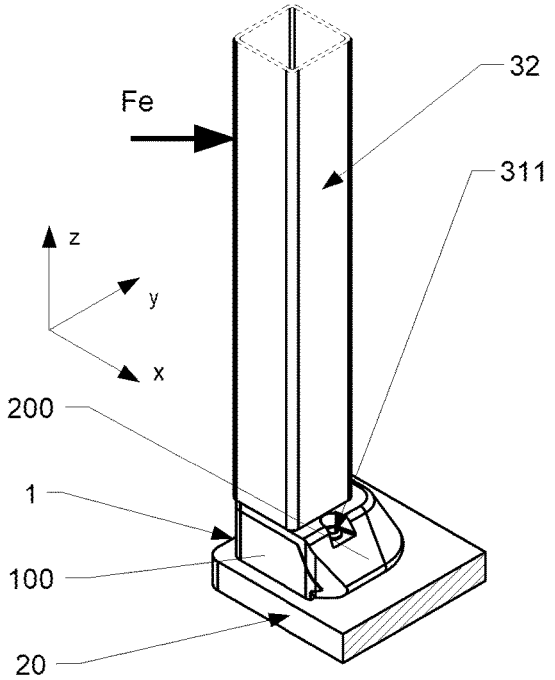
FIG. 7-9 schematically show application of an increasing external force to a structural entity on a container interconnected with a variation of a connector assembly according to the present disclosure in a perspective view from above.
Figure 8:
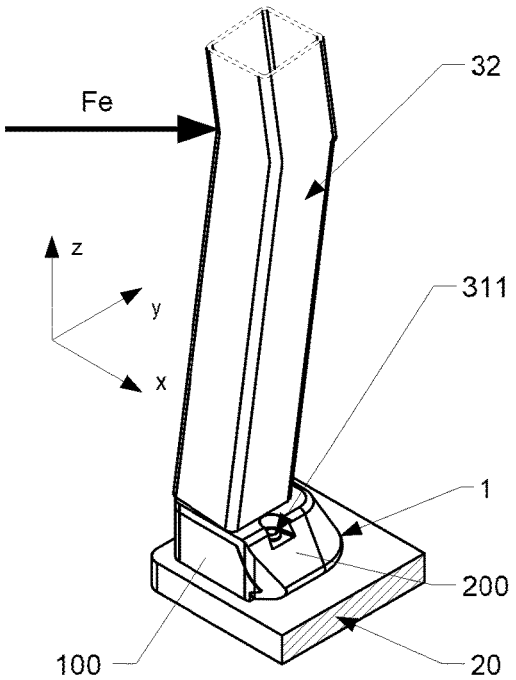
Figure 9:
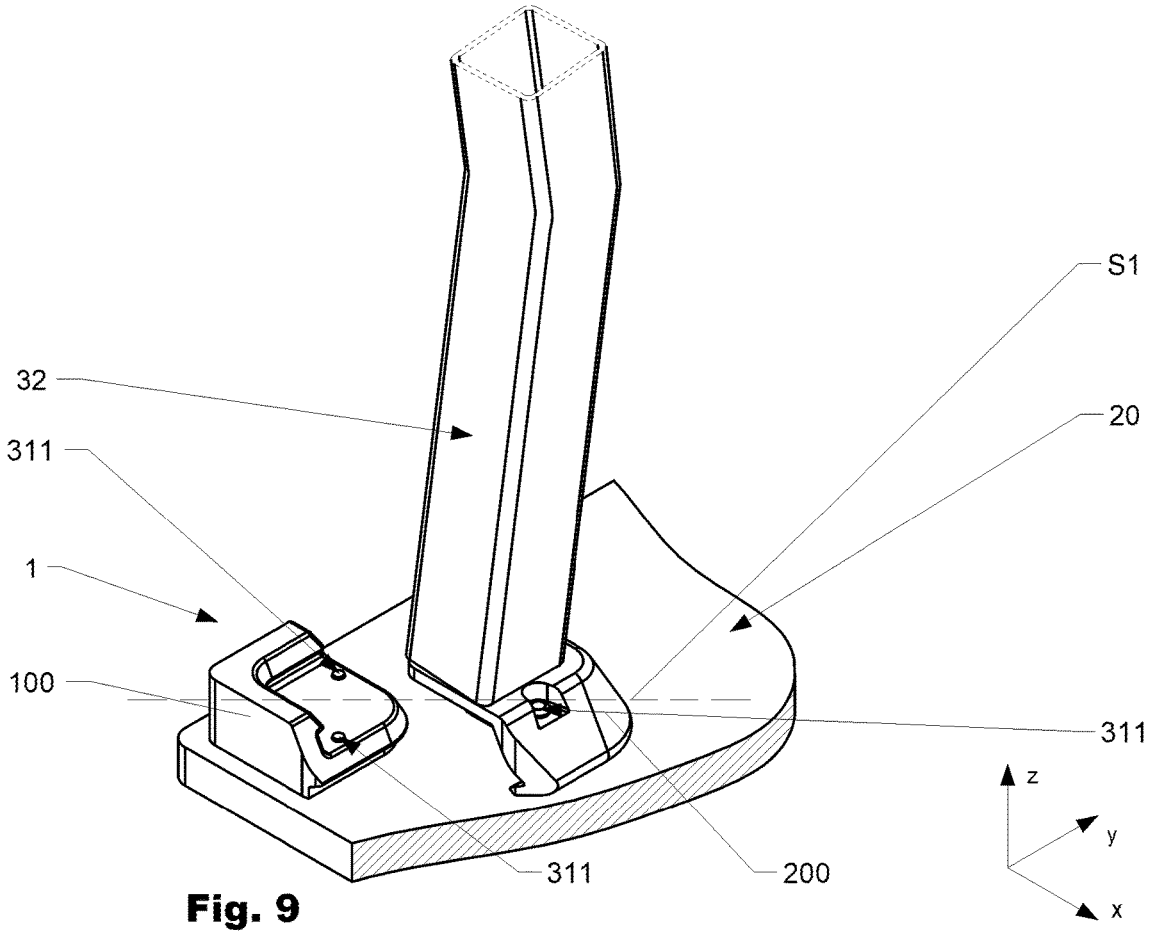

FIGS. 7 to 9 schematically show loading of a vertical beam 32 (for illustrative purposes only the lower part is shown) that is part of a major structural framework of a container (not shown) by an increasing external force Fe, the vertical beam 32 being fastened to a variation of a connector assembly 1 according to the present disclosure. As can be seen in FIG. 8, the external force Fe causes damage to the vertical beam 32, but is not yet critical for the major structural framework of the container. Just after the external force Fe is increased, the shear pins 311 of the connector assembly 1 break and allow the second connector part 200 to move relative to the first connector part 100 along the axis of action S1. By this relative movement, the vertical beam 32 is partially decoupled/disconnected from the rest of the framework of the container. This reliably prevents the residual framework from mechanical damage due to overloading. It is clear, that depending on the application, the shear pins 311 may also be configured such that a relative movement is already allowed before the vertical beam 32 is significantly damaged.

Figure 10:
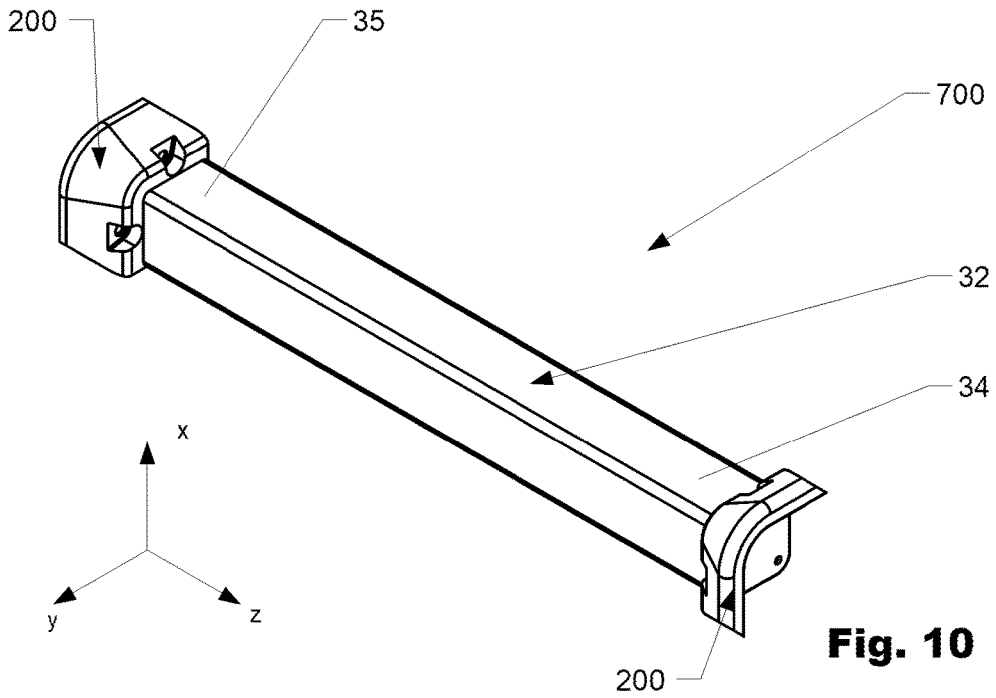
FIG. 10 a variation of a structural module according to the present disclosure in a perspective view from above.

FIG. 10 schematically depicts a structural module 700 to be used for a container as e.g. shown in FIG. 1. The structural module 700 comprises a beam 32, which has at its first as well as at its second beam ends 34,35 second connector parts 200 of a connector assembly 1 as shown in the other Figures. Such a structural module 700 may e.g. be used as a structural replacement part for a mechanically damaged beam of a container (not shown).

Rather, the words used in the specification are words of description rather than limitation, and it is understood that various changes may be made without departing from the spirit and scope of the disclosure.

Figure 11:
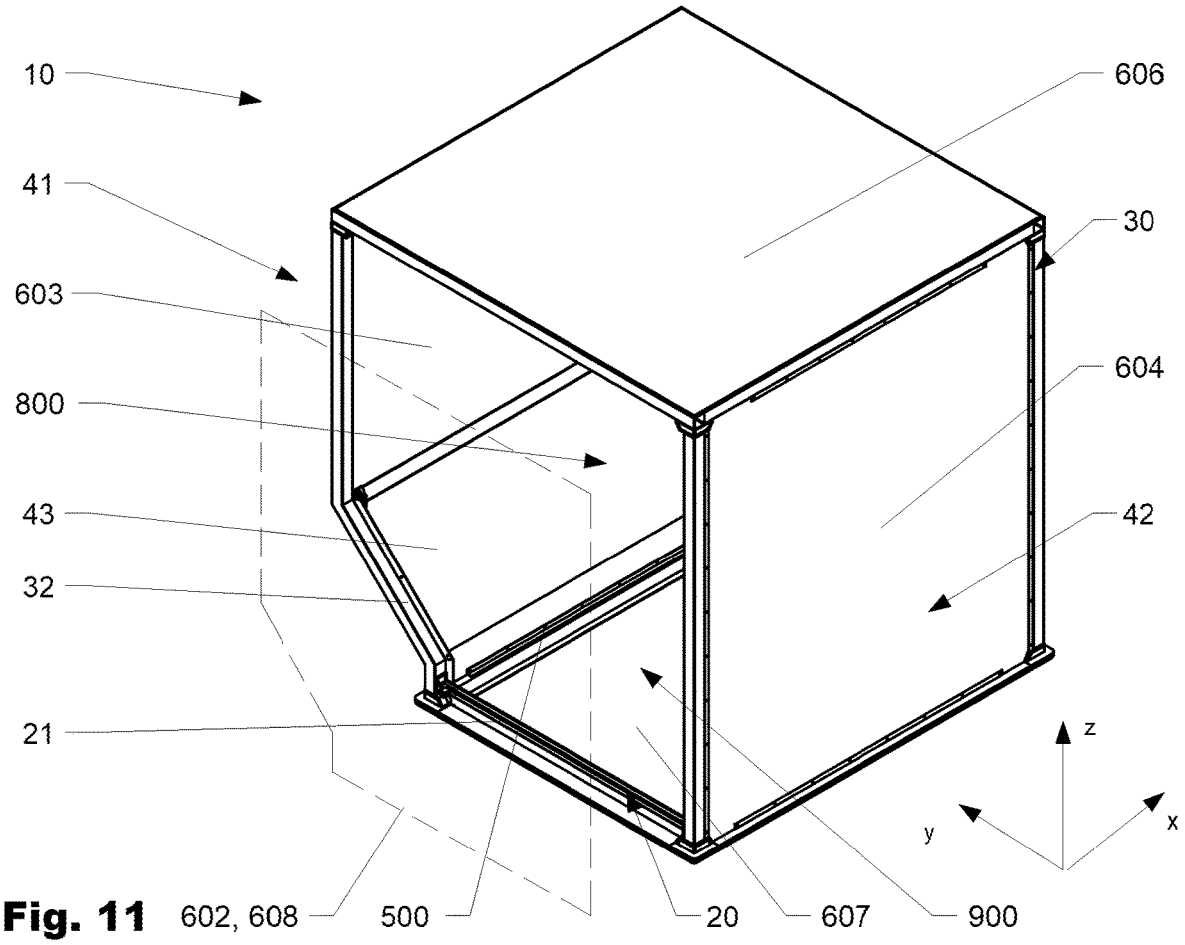
FIG. 11 shows a further variation of a container according to the present disclosure in a perspective view from above.

FIG. 11 shows a further variation of the container 10 according to the disclosure. The shown container 10 is a container 10 according to FIG. 1 with additional panels 600 attached to the respective sides of the container 10. The panels 600 are attached to the superstructure 30 and the base structure 20 via interconnection means 500. In the shown variation, the interconnection means 500 attach the panels 600 to the respective beams of the superstructure and the base structure 30, 20.

The rear side 41 of the container 10 hereby features a tapered surface 43, which extends between the two (bend) vertical beams 32, as explained before. The rear side 41 may be covered by at least one rear panel 603. Preferably, the rear panel(s) 603 are made of metal sheets. For additional stiffness, the superstructure 30 may feature an additional beam in the area of the tapered surface 43 (not shown) and/or the at least one rear panel 603 covering the tapered surface 43 may feature a thicker sheet metal.

The container 10 further comprises a cargo opening 900 extending over an entire side surface 40 of the container 10. A removable panel 602 (shown schematically), made e.g. of plastic tarpaulin, may cover and temporarily close the cargo opening. As it can be seen, the respective removable panel 602, covering the side surface 40 can have an irregular hexagonal shape. However, other shapes are also possible. Alternatively, a roller blind 608 (shown schematically) may be attached to temporally close the cargo opening 900. The side surface 40 opposite of the removable panel 602 is preferably closed by a side panel.

In the shown variation, the front panel 604, the side panel opposite of the removable panel 602 as well as the top and the bottom panel 606, 607 are made of composite material. The at least one rear panel 603 is made of metal. However, other combinations of materials are also possible.

The invention claimed is:

1. A connector assembly for use in mechanically interconnecting a first structural entity of an aircraft container with a second structural entity of the aircraft container comprising:

a. a first connector part, comprising a first stop means, and configured to be fastened to the first structural entity of the aircraft container and b. a second connector part, comprising a corresponding second stop means, and configured to be fastened to the second structural entity of the aircraft container and c. when the connector assembly is in a connected state the first stop means of the first connector part and the corresponding second stop means of the second connector part, are configured to prevent relative movement of the second connector part with respect to the first connector part by forming a form fit in a first direction along a first axis of action and to allow relative movement of the second connector part with respect to the first connector part in a second direction opposite to the first direction along the first axis of action, and d. comprising a force-limiting arrangement, such that when the connector assembly is in the connected state, limits relative movement of the second connector part with respect to the first connector part in the second direction opposite to the first direction and along the first axis of action, and wherein e. when an external force is applied to the second connector part and the external force has a first force component that acts in the second direction and exceeds a specified first threshold force the force-limiting arrangement allows the second connector part to move relative to the first connector part in the second direction along the first axis of action, wherein relative movement in the first direction keeps being prevented by the first and second stop means.

2. The connector assembly according to claim 1, wherein when the connector assembly is in the connected state, the first and the second connector parts are configured to restrict relative movement of the second connector part with respect to the first connector part in a third direction along a second axis of action that is perpendicular to the first axis of action and wherein the force-limiting arrangement limits relative movement of the second connector part with respect to the first connector part in a fourth direction opposite to the third direction and allows the second connector part to displace in the fourth direction with respect to the first connector part if a second force component of the applied external force acts in the fourth direction and exceeds a specified second threshold force.

3. The connector assembly according to claim 2, wherein the force-limiting arrangement is configured to allow relative movement of the second connector part with respect to the first connector part in both the second direction and the fourth direction when either the first force component exceeds the first threshold force the second force component exceeds the second threshold force.

4. The connector assembly according to claim 1, wherein when the connector assembly is in the connected state, a first rotation restriction means restricts rotations of the first and the second connector parts relative to each other in at least one direction of rotation about a first axis of rotation wherein the first axis of rotation is perpendicular to the first axis of action.

5. The connector assembly according to claim 4, wherein the first rotation restriction means comprises at least one first rotation engagement surface arranged at the first connector part and at least one corresponding second rotation engagement surface arranged at the second connector part, the at least one first and second engagement surfaces arranged in physical contact in the connected state and thereby restrict rotations about the first axis of rotation in a first direction of rotation.

6. The connector assembly according to claim 5, wherein the first rotation restriction means comprises at least one third rotation engagement surface arranged at the first connector part and at least one corresponding fourth rotation engagement surface arranged at the second connector part, the at least one third and fourth engagement surfaces arranged in physical contact in the connected state and thereby restrict rotations about the first axis of rotation in a second direction of rotation that is opposite to the first direction of rotation.

7. The connector assembly according to claim 1, wherein the force-limiting arrangement comprises at least one sacrificial member that fails under a critical force and thereby enables a relative movement of the second connector part with respect to the first connector part.

8. The connector assembly according to claim 7, wherein the sacrificial member comprises a shear pin that fails under the critical force.

9. The connector assembly according to claim 1, wherein a centering means assists in positioning of the first and the second connector parts relative to each other when the connector assembly is in the connected state.

10. A container comprising a base structure having at least three perimeter edges constituting a base plane, and further comprising a superstructure that is mechanically interconnected with the base structure by at least one connector assembly according to claim 1, wherein the first connector part of the at least one connector assembly is arranged at one of the at least three perimeter edges and fastened to the base structure such that the first axis of action is essentially in parallel with the base plane and the first direction points away from the base structure.

11. The container according to claim 10, wherein the superstructure comprises multiple beams that constitute a framework.

12. The container according to claim 11, wherein the framework comprises at least one vertical beam that is aligned perpendicular to the base plane and comprises a first beam end that is fastened to the second connector part of the at least one connector assembly.

13. The container according to claim 12, wherein the at least one vertical beam has a second beam end that is fastened to the second connector part of a second connector assembly, the second connector assembly arranged such that the first axis of action of the second connector assembly is in parallel with the base plane and the first direction of the second connector assembly points to the outside of the container and the first connector part of the second connector assembly being fastened to a top structure of the superstructure.

14. The container according to claim 11, wherein the framework comprises at least one panel that comprises at least one strut which interconnects two diagonally opposite corners of the panel.

15. A structural module to be used for the container according to claim 10, wherein the structural module comprises at least one structural entity and at least one first or second connector part of the connector assembly.

16. The container according to claim 10, wherein a. multiple panels extend between at least one of beams of the superstructure and the base structure to enclose a cargo space, and b. at least one removable panel is covering a cargo opening into the cargo space.

17. The container according to claim 16, wherein the removable panel extends over an entire side surface of the container.

18. The container according to claim 16, wherein the removable panel is made of plastic tarpaulin.

19. The container according to claim 16, wherein the removable panel has the shape of the cross-section of the cargo space in a direction parallel to the removable panel.

20. The container according to claim 16, wherein the removable panel is a roller blind.

21. The container according to claim 16, wherein the container comprises at least one panel made of composite material.

22. The container according to claim 16, wherein the container comprises a rear side having a tapered surface.

23. The container according to claim 22, wherein the rear side is covered by at least one rear panel made of metal.

* * * * *